US008780674B2

(12) United States Patent
Mosca et al.

(10) Patent No.: US 8,780,674 B2
(45) Date of Patent: Jul. 15, 2014

(54) ACOUSTIC WAVE TRANSDUCER AND SONAR ANTENNA WITH IMPROVED DIRECTIVITY

(75) Inventors: Frederic Mosca, Marseilles (FR); Pascal Girardi, Toulon (FR); Robert Girault, Le Beausset (FR); Yann Cottreau, Le Beausset (FR); Guillaume Matte, La Ciotat (FR); Samuel Thomas, Marseilles (FR)

(73) Assignee: Ixblue, Marly le Roi (FR)

( * ) Notice: Subject to any disclaimer, the term of this patent is extended or adjusted under 35 U.S.C. 154(b) by 476 days.

(21) Appl. No.: 13/141,823

(22) PCT Filed: Dec. 23, 2009

(86) PCT No.: PCT/FR2009/052682

§ 371 (c)(1),
(2), (4) Date: Jun. 23, 2011

(87) PCT Pub. No.: WO2010/072984

PCT Pub. Date: Jul. 1, 2010

(65) Prior Publication Data

US 2011/0255375 A1 Oct. 20, 2011

(30) Foreign Application Priority Data

Dec. 23, 2008 (FR) ..... 08 59015

(51) Int. Cl.

| | |
|---|---|
| ***H04R 17/00*** | (2006.01) |
| ***B06B 1/06*** | (2006.01) |
| *H04R 1/44* | (2006.01) |

(52) U.S. Cl.

CPC ..... *B06B 1/0618* (2013.01); *H04R 17/00* (2013.01); *H04R 1/44* (2013.01)

USPC ..... 367/158; 367/162; 367/176

(58) Field of Classification Search

CPC ..... B06B 1/0618; H04R 17/00; H04R 1/44

USPC ..... 367/157, 162, 176

See application file for complete search history.

(56) References Cited

U.S. PATENT DOCUMENTS

| | | | |
|---|---|---|---|
| 3,474,403 | A | 10/1969 | Massa et al. |
| 3,593,257 | A | 7/1971 | Massa et al. |

(Continued)

FOREIGN PATENT DOCUMENTS

| | | | |
|---|---|---|---|
| DE | 39 31 453 | C1 | 2/1991 |
| EP | 0 728 535 | A1 | 8/1996 |

(Continued)

OTHER PUBLICATIONS

International Search Report, dated Apr. 9, 2010, from corresponding PCT application.

*Primary Examiner* — Luke Ratcliffe
*Assistant Examiner* — Hovhannes Baghdasaryan
(74) *Attorney, Agent, or Firm* — Young & Thompson

(57) ABSTRACT

An acoustic wave transducer includes at least one electroacoustic motor, a horn having an inner wall and an outer wall, a counterweight, and a hollow housing having an inner wall and an outer wall and at least one acoustic opening. The electroacoustic motor is connected to the horn and to the counterweight along an axis, and the electroacoustic motor is capable of exciting the horn at about at least one resonance frequency. The housing is connected to the counterweight and surrounds the motor and the horn, the outer wall of the horn being arranged opposite an acoustic opening of the housing, and the space between the inner wall of the housing and the inner wall of the horn defines a cavity that contains a fluid. The transducer includes acoustic attenuation elements connected to the outer wall of the housing in order to attenuate the emission and/or reception acoustic waves at the frequency at least in a direction transverse to the emission/reception axis. A sonar antenna that includes at least one transducer is also described.

18 Claims, 4 Drawing Sheets

(56) References Cited

U.S. PATENT DOCUMENTS

Figure 1:
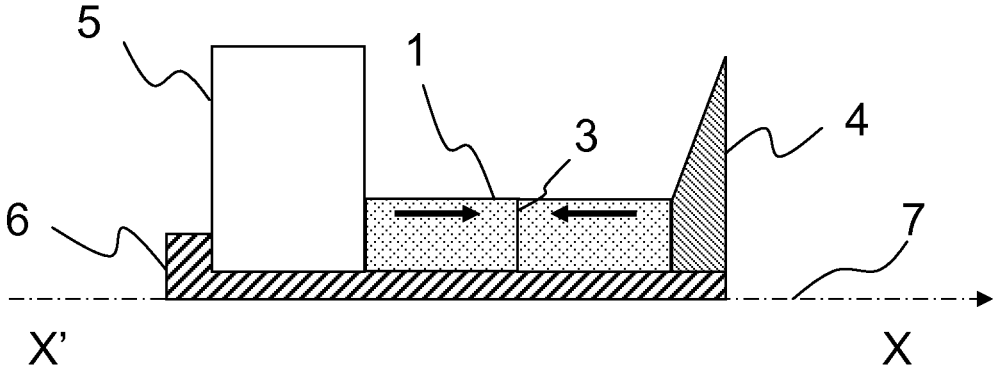

| | | | | |
|---|---|---|---|---|
| 4,031,418 | A | 6/1977 | Cluzel et al. | |
| 4,151,437 | A * | 4/1979 | Tocquet | 310/337 |
| 4,164,727 | A * | 8/1979 | Morris | 181/5 |
| 5,191,316 | A | 3/1993 | Dreyer | |
| 5,243,567 | A * | 9/1993 | Gingerich | 367/176 |
| 5,363,345 | A * | 11/1994 | Boucher et al. | 367/162 |
| 5,436,874 | A * | 7/1995 | Kuhn et al. | 367/176 |
| 5,694,374 | A | 12/1997 | Ripoll et al. | |
| 5,898,642 | A * | 4/1999 | Wagner | 367/158 |
| 6,232,702 | B1 * | 5/2001 | Newnham et al. | 310/334 |
| 6,731,466 | B2 * | 5/2004 | Arya | 360/244.3 |
| 7,309,948 | B2 * | 12/2007 | Kuniyasu et al. | 310/334 |
| 2005/0075571 | A1 * | 4/2005 | Barnes | 600/459 |
| 2008/0277198 | A1 * | 11/2008 | LaWhite et al. | 181/198 |

FOREIGN PATENT DOCUMENTS

| | | |
|---|---|---|
| GB | 2357843 | 7/2001 |
| JP | 62154897 | 10/1987 |
| JP | 63144697 | 6/1988 |
| JP | 03079490 | 4/1991 |
| JP | 06046495 | 2/1994 |
| JP | 2002517763 | 6/2002 |
| JP | 2002204498 | 7/2002 |

* cited by examiner

ACOUSTIC WAVE TRANSDUCER AND SONAR ANTENNA WITH IMPROVED DIRECTIVITY

BACKGROUND OF THE INVENTION

1. Field of the Invention

The present invention relates to an electroacoustic transducer for a sonar antenna. An electroacoustic transducer is used for the emission and/or the reception of acoustic pressure waves. In emission mode, an acoustic transducer transforms an electric potential difference into an acoustic pressure wave (and the reverse in reception mode).

2. Description of the Related Art

Different types of electroacoustic transducers exist. In the following of this document, particular reference will be made to the piezoacoustic transducers of the Tonpilz and Janus-Helmholtz type. Those transducers comprise a piezoelectric motor, constistuted generally of a stack of piezoelectric ceramics and electrodes, such piezoelectric motor being connected, on the one hand, to a counterweight, and on the other hand, to a horn. The piezoelectric motor, counterweight and horn assembly is connected to a prestressing rod and forms a resonator, the resonance frequency of which depends in particular on the dimensions of the horn, the motor and the counterweight.

The piezoacoustic resonator is generally placed in a sealed protective housing. The outer face of the horn is in direct contact with the immersion medium or placed behind an acoustically transparent membrane. The inner cavity of the housing is filled either with air or with a fluid chosen so as to provide a good acoustic impedance without impedance loss or discontinuity. The fluid used is generally oil. When the cavity is filled with air, the acoustic coupling between the transducer and the immersion medium is made by the outer face of the horn. When the cavity is filled with oil, the acoustic coupling between the transducer and the immersion medium is made by the horn through the oil and the housing. The immersed transducer transforms the vibration wave of the resonator into an acoustic pressure wave that propagates through the immersion medium.

An electroacoustic transducer permits to sound an acoustic echo. The specific response of a transducer depends on the frequency, on the bandwidth and on the direction of the echo with respect to the emission/reception axis of the transducer. In bathymetry applications, the transducer is placed vertically so as to sound the echo coming from the sea floor. It is then essential to sound the acoustic waves in a precise direction. Indeed, the secondary echo sources generate noise and reduce the device sensitivity.

Figure 2:
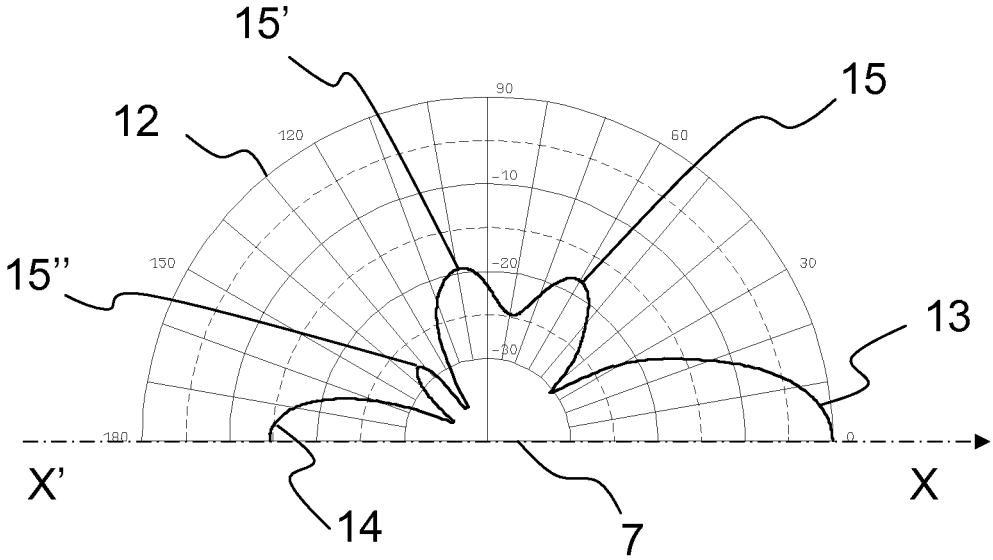

A directivity diagram represents the acoustic intensity as a function of the direction of measurement (angularly registered). The directivity diagram indicative of the response of a Tonpilz-type transducer as a function of the direction with respect to the transducer acoustic axis is schematically shown in FIG. 2. As this diagram 12 is symmetric with respect to the acoustic axis 7 of the transducer (axis 0-180°, only half of the diagram is shown. The curve of this diagram is a curve of acoustic intensity level. It can be observed in the diagram of FIG. 2 a primary lobe 13 centred on the acoustic axis 7 of the transducer and oriented in the direction X toward the horn front. The diagram of FIG. 2 also shows a rear lobe 14, on the acoustic axis and in the direction X' opposite to the main lobe 13. It can also be observed in FIG. 2 parasitic secondary lobes 15, 15', 15", in directions comprised between 40° and 140° with respect to the acoustic axis. The presence of the secondary lobes impairs the directivity of the transducer, which receives and/or emits an acoustic energy in directions different from the direction X of the transducer axis toward the horn front.

The Tonpilz-type transducers operate at frequencies between 1 kHz and 800 kHz. The problem of the secondary lobes appears when the characteristic dimension of the emitting face is of the order of or higher than the working wavelength. The wavelength $\lambda$ being defined as being related to the frequency f by the relation $\lambda=c/f$, where c is the speed of the acoustic wave in the immersion medium (the speed of sound in sea water is about 1500 m/s). The problem of the secondary lobes thus appears more easily at high frequencies>50 kHz (because the wavelengths become of the order of the centimeter).

These secondary lobes are generally attributed to an imperfect decoupling between the piezoelectric motor and the housing, for which reason they are called "housing lobes". Moreover, it is known that the pressure forces in deep immersion produce deformations and do not permit a decoupling of the motor and the housing.

Another type of transducer is derived from the Tonpilz structure; it is the Janus-Helmholtz-type transducer. Indeed, a Janus-Helmholtz transducer comprises two piezoacoustic motors aligned along a same axis and fixed to a central counterweight, each piezoacoustic motor being connected to a horn by a prestressing rod. The two horns are thus located at the opposite ends, on the axis of the device, and are symmetric with respect to a plane transverse to the axis. A Janus-Helmholtz transducer makes it possible to work at lower frequencies (from 150 Hz to 20 kHz) than a Tonpilz-type transducer.

The directivity diagram of a Janus-Helmholtz-type transducer operating at very low frequency (from 150 Hz to 20 kHz) is generally very little directive. This diagram is symmetric with respect to the transverse plane of symmetry. However, it has two power maxima on the transducer axis, in the front direction of each horn. But the power emitted or received in the direction transverse to the acoustic axis may also induce disturbances. Moreover, when a Janus-Helmholtz transducer is used at a relatively higher frequency, secondary lobes also appear.

Known solutions exist to improve the directivity of an electroacoustic transducer. The counterweight of the transducer acts as a vibration node and is thus a fixed point that is important for the transducer directivity. Therefore, the transducer directivity is improved by connecting the counterweight to the housing by a metal plate (aluminium, stainless steel, steel . . . ).

However, the secondary lobes in site around the normal to the acoustic axis are major limitations for a sonar antenna, and that whatever the type of transducer used (cf. FIG. 2). Indeed, these secondary lobes cause the presence of surface echoes and significantly deteriorate the shadow contrast of the system.

Tools for modelling the frequency response of a Janus-Helmholtz-type transducer exist, but those tools do not manage to perfectly simulate the behaviour of a transducer.

SUMMARY OF THE INVENTION

One of the goals of the invention is to improve the directivity of an electroacoustic transducer of the Tonpilz or Janus-Helmholtz type. Another goal of the invention is to reduce the housing lobes in an electroacoustic-type transducer.

The invention relates to an acoustic wave transducer comprising at least one electroacoustic motor, a horn having an inner wall and an outer wall, a counterweight, and a hollow housing having an inner wall and an outer wall and at least one acoustic opening. Said electroacoustic motor is connected, on the one hand, to the horn, and on the other hand, to the counterweight, according to an axis, and said electroacoustic motor is capable of exciting the horn at about at least one resonance frequency f. Said housing is connected to the counterweight and surrounds the motor and the horn, the outer wall of the horn being placed opposite an acoustic opening of the housing, and the space between the inner wall of the housing and the inner wall of the horn forming a cavity that contains a fluid. According to the invention, said transducer comprises acoustic attenuation means integral with the outer wall of the housing in order to attenuate the emission and/or reception acoustic waves at the frequency f in at least one direction transverse to the emission/reception axis.

According to a first embodiment, the housing has a wall that extends longitudinally according to the transducer axis and of thickness E, said thickness E being greater than the acoustic wavelength $\lambda$ corresponding to the frequency f in the housing so as to absorb a part of the acoustic waves at the frequency f in at least one direction transverse to the axis.

Said attenuation means may further comprise an absorbing sheath fixed to the outer wall of the housing and capable of absorbing acoustic waves at the frequency f in at least one direction transverse to the axis.

Said attenuation means may further comprise a diffraction grating surrounding the absorbing sheath, said grating being capable of diffracting acoustic waves in the bandwidth of the transducer and suspension means capable of damping the acoustic wave coupling between the diffraction grating and the absorbing sheath.

Said attenuation means may further comprise a reflecting sheath around the diffraction grating and suspension means capable of damping the acoustic wave coupling between the reflecting sheath and the absorbing sheath.

According to a particular embodiment, the reflecting sheath is made of aluminium, the absorbing sheath is made of polymer resin or syntactic foam, and the suspension means are made of viscoelastic polymer.

According to a particular embodiment, the reflecting sheath has a rounded outer shape so as to attenuate a part of the acoustic waves coming from the immersion medium in directions transverse to the axis.

According to a preferred embodiment, the transducer is a Tonpilz-type transducer, comprising an elongated piezoelectric motor, said motor comprising a stack of piezoelectric components and electrodes, the stack being connected, according to an axis of symmetry, to the horn by one end and to the counterweight by the other end.

According to another embodiment, the transducer is a Janus-Helmholtz-type transducer comprising two elongated piezoelectric motors, the axes of which are aligned with each other, each motor comprising a stack of piezoelectric components and electrodes, the stack being connected, according to an axis of symmetry, to a horn by one end and to the central counterweight common to the two motors by the other end, said transducer comprising two housings surrounding each motor-horn subassembly.

The invention also relates to a sonar antenna comprising a plurality of transducers, said transducers being placed in a common housing according to one of the preceding embodiments.

The present invention also relates to the characteristics that will be revealed by the following description and that will be considered either alone or in any technically possible combination thereof.

BRIEF DESCRIPTION OF THE DRAWING FIGURES

Figure 3:
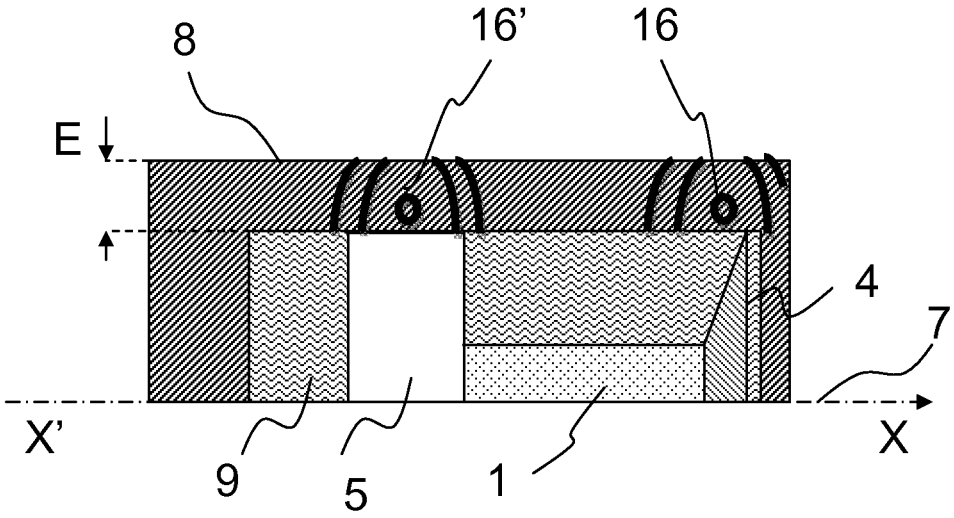
Figure 4:
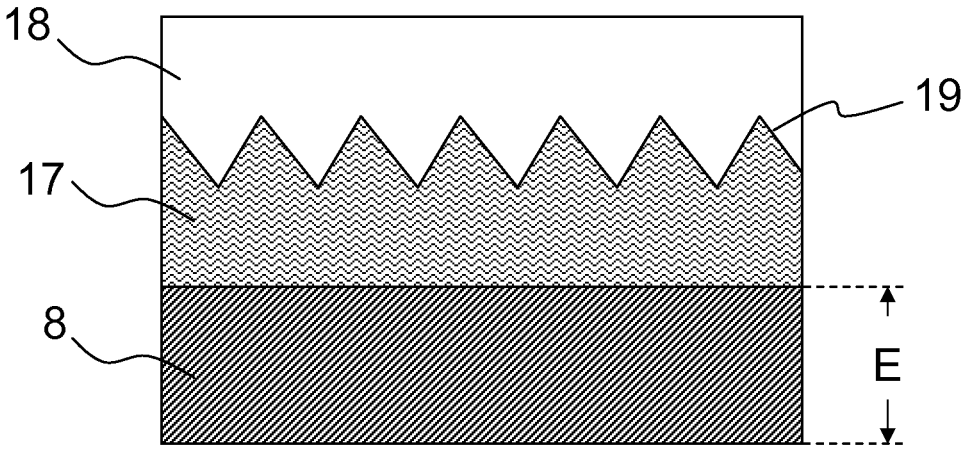
Figure 5:
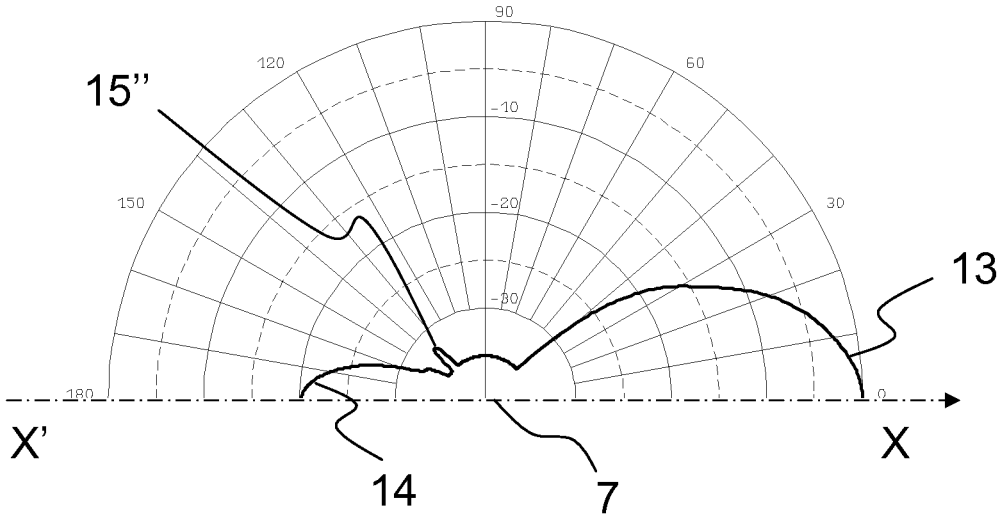
Figure 6:
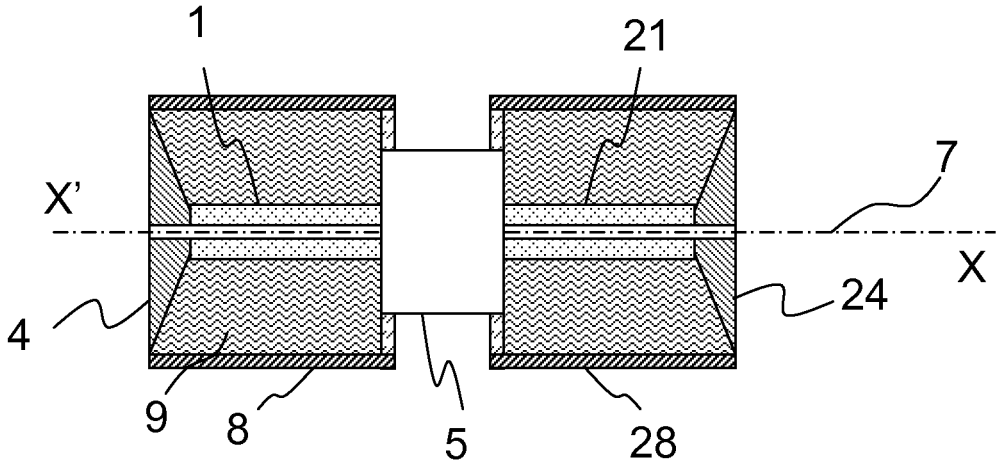
Figure 7:
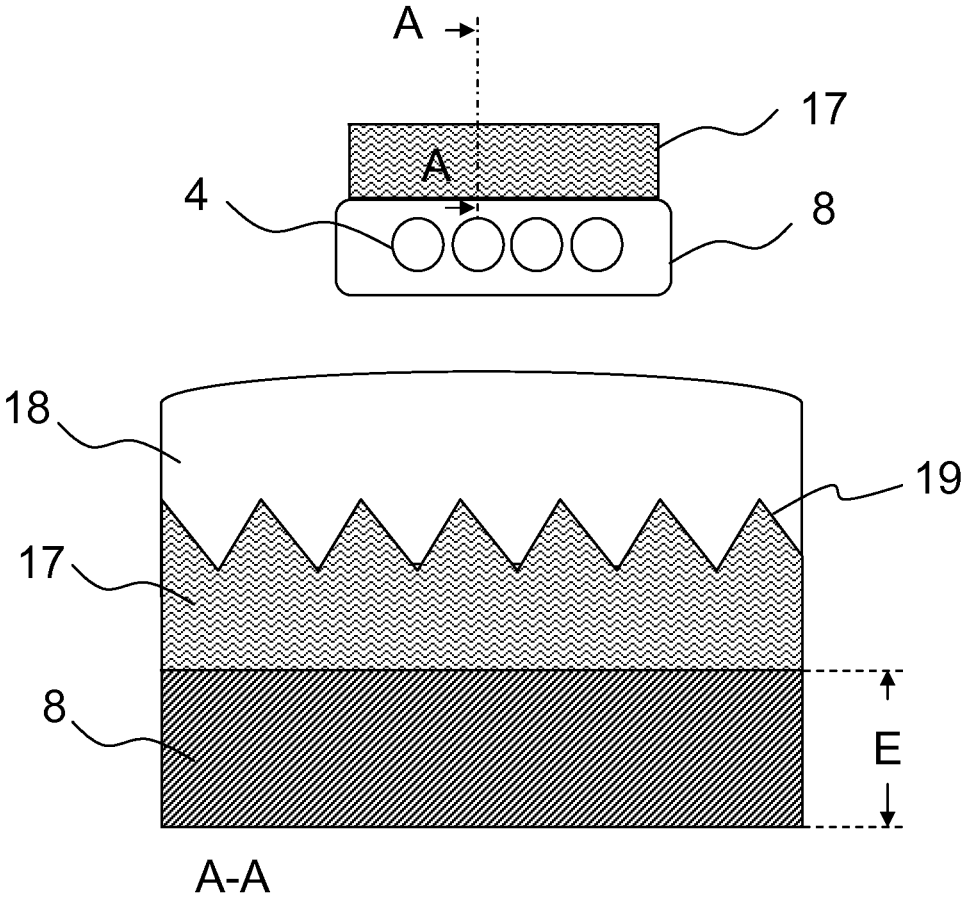

Such description is given by way of non-limitative example and will permit to better understand how the invention can be implemented, with reference to the appended drawings, in which:

FIG. 1 schematically shows the inner components of a Tonpilz-type acoustic transducer having a rotational symmetry around its axis (half-sectional view without the casing);

FIG. 2 shows an example of directivity diagram of a Tonpilz-type acoustic antenna;

FIG. 3 schematically shows a Tonpilz-type acoustic transducer with its housing;

FIG. 4 schematically shows a sectional view of means for attenuating the housing lobes;

FIG. 5 illustrates the representative directivity diagram of a Tonpilz acoustic antenna according to the invention;

FIG. 6 schematically shows a sectional view of a Janus-Helmholtz-type acoustic transducer;

FIG. 7 shows a sonar antenna comprising several transducers in a same housing.

DETAILED DESCRIPTION OF THE INVENTION

FIG. 1 shows a partial view of a Tonpilz transducer (the housing is not shown), the transducer being of rotational symmetry around the acoustic axis 7. The transducer comprises an electroacoustic motor 1 connected to a horn 4 and a counterweight 5 by a prestressing rod 6. In the example shown, this motor comprises piezoelectric ceramics connected to electrodes 3 that are subjected to a sinusoidal voltage. The piezoelectric ceramics thus undergo a sinusoidal mechanic deformation in the direction of polarization of the ceramics. The horn 4 ensures a dual function of enlarging the transducer bandwidth due to the flicker eigenmode thereof and of adapting the acoustic impedance between the ceramic and the fluid medium. The counterweight 5 stabilizes the whole and shifts the nodal plane of vibration toward the rear of the transducer, ensuring a maximum transmission of the energy in the desired direction of the acoustic axis toward the front of the horn 4. The prestressing rod 6 holds the acoustic motor-horn-counterweight assembly under a prestress so as to ensure the operation thereof in compression only.

The Tonpilz transducer is integrated within a housing 8 (not shown in FIG. 1) filled with oil 10 so as to ensure the pressure balance with the immersion medium in which the transducer is dived. Generally, the counterweight 5 is forcibly mounted in the housing 8. The secondary lobes or housing lobes (cf. FIG. 2) are a drawback that is known for many years in the transducers, in particular the Tonpilz-type transducers.

The inventors have analysed the behaviour of such a transducer. According to this analysis, the generation of these secondary lobes called "housing lobes" is due to a coupling between the elements of the transducer (horn and counterweight), the fluid in which the resonator soaks, and the housing. This coupling translates into the generation of four shear waves from two sources 16 and 16' within the housing 8, each of the sources 16, 16' generating two shear waves in opposite directions. The origin of the secondary lobes is a coupling related to a mode conversion of a shear wave propagating inside the housing. A first acoustic coupling occurs between the fluid 9 and the housing 8. This coupling generates a first source 16 of shear waves, schematically shown at the horn in the housing. Unexpectedly, the coupling does not occur only at the interface between the fluid medium and the housing but a second mechanic coupling is located at the counterweight.

According to the applications and the type of assembling, the counterweight is not necessarily a perfectly still node of vibration, but undergoes displacements transverse to the axis. These displacements induce shear waves from a secondary focus 16' schematically shown in FIG. 3 in the housing opposite the counterweight. The combination of coupling waves coming from two focuses 16 and 16' further produces interfering waves.

Such couplings translate into the generation of four shear waves within the housing, which are schematically shown in FIG. 3. By mode conversion, transformation of the wave S into a wave P, and after having interfered with each other, these waves propagate as compression waves within the fluid medium and form secondary lobes called "housing lobes".

The invention proposes various complementary means for trapping the energy of the secondary lobes. FIG. 4 schematically shows a housing part, in sectional view, comprising different means for attenuating the acoustic waves. These means are advantageously arranged on the sides of the housing that extend longitudinally with respect to the acoustic emission/reception axis 7 of the transducer, so as to attenuate the acoustic waves propagating in directions substantially transverse (90±40 degrees) to the acoustic axis 7. The attenuation means may be placed on one or several flanks around the axis, or may form a continuous sheath that surrounds the periphery of the housing around the acoustic axis.

More precisely, a first means consists in increasing the housing thickness so that the latter is greater than the acoustic wavelength λ corresponding to the frequency f in the housing. Preferably, the thickness of the housing is equal to about 2λ or 3λ. Such a housing thickness makes it possible to convert the shear wave into a compression wave. For example, for a Tonpilz transducer whose frequency is 100 kHz, a casing of 2.5-3 cm thick suits well. For a Tonpilz of lower frequency, the adapted thickness will be proportional to the frequency.

Preferably, the housing thickness is uniform over all the faces of the housing extending longitudinally with respect to the axis. Advantageously, the rear face of the housing has also a thickness greater than λ, so as to attenuate the rear lobe 13 in the direction X' opposite to the direction X of acoustic emission/reception.

A housing thickness greater than λ, or even than 2λ or 3λ, may be obtained by manufacturing directly a housing with such a thickness. For the devices having already a housing with an insufficient initial thickness, a second housing, whose inner shape is adapted to the outer shape of the initial housing, may be arranged so that the total thickness of the thus-obtained housing is greater than λ.

A second means consists in arranging an absorbing sheath 17 around the housing 8 so as to absorb the energy of the shear waves converted into compression waves. For a mode conversion, the absorbing sheath has to be made in a softer material than the housing, for example a polymer resin. A foam layer may also be placed above the absorbing structure so as to impose a second path in the structure and then double the attenuation.

A third means consists in placing a diffraction grating 19 at the surface of the absorbing sheath. The grating 19 may be a one-dimension grating with a pitch and a depth of the order of the half-wavelength. The grating 19 may also be two-dimensional.

A fourth means consists in placing a reflecting sheath 18 around the absorbing sheath and the diffraction grating so as to increase the step of the shear waves converted into compression waves in the absorbing medium. The reflecting sheath 18 may comprise, for example, a reflecting casing made of a material having a high impedance contrast with the absorbing sheath. A strong impedance disruption is required for the reflecting material, which may be a metal. This structure finally requires suspension means for the reflecting material, so as to isolate this material and to avoid the transmission by vibratory coupling in the non-desired direction. The suspension means advantageously comprise a viscoelastic polymer.

Preferably, the surface of the reflecting layer 18 is concave in shape as viewed from the sources 16 and 16'.

The order in which the means for attenuating the secondary lobes are assembled from the transducer axis toward the outside of the housing is important and is preferably the order indicated above.

Likewise, to reduce the rear lobe, attenuation means may be placed on the rear face of the housing.

The various technical means implemented have an additive effect to improve the transducer directivity and to reduce the secondary lobes. FIG. 5 shows a simulation of the directivity diagram of the same Tonpilz transducer as that of FIG. 2, but provided with the above-described means, and more precisely with all the means cumulated with each other, except the reflecting sheath. It can be observed in FIG. 5 a strong reduction of the secondary lobes, which have almost disappeared. The rear lobe 14 is also reduced. The transducer directivity is thus significantly improved.

The device of the invention thus permits to improve the directivity and sensitivity of an electroacoustic transducer.

The invention can be adapted to any type of sonar, with a light modification of the outer casing of the transducer.

The invention applies in particular to the Janus-Helmholtz-type transducers, as schematically shown in sectional view in FIG. 6. The Janus-Helmholtz transducer comprises two piezoacoustic motors, respectively 1 and 21, aligned along a same axis 7 and fixed to a central counterweight 5. Each piezoacoustic motor 1, 21 is connected to a horn 4, 24, by a prestressing rod. The two horns 4, 24 are thus located at the opposite ends on the axis 7 of the device. A housing 8, respectively 28, surrounds each motor-horn subassembly 1 and 4, respectively 21 and 24. The counterweight is fixed by a metal plate, on the one hand, to the housing 8, and on the other hand, to the housing 28. The inner cavity of each housing 8, 28 is filled with a fluid. Similarly to the invention described above in connection with a Tonpilz transducer, the housings 8 and 28 may be modified so that they comprise means for attenuating the emitted and/or received acoustic waves in directions transverse to the acoustic axis 7. It may be applied one or several means for attenuating the waves in a direction transverse to the housing of each of the two coaxial resonators. The first means consists in using housings 8 and 28 of thickness greater than λ, and preferentially equal to 2λ or 3λ. A second means consists in fixing an absorbing sheath to a wall of the housing extending longitudinally according to the axis 7. A third means consists in placing a diffraction grating at the surface of the absorbing sheath. A fourth means consists in placing a reflecting sheath around the absorbing sheath and the diffraction grating so as to increase the step of the shear waves converted into compression waves in the absorbing medium.

The Janus-Helmholtz transducer provided with such means for attenuating the acoustic waves transverse to the acoustic axis 7 has an improved directivity.

The invention will find a particularly advantageous application in the sonar antennas. FIG. 7 schematically shows a front view of a sonar antenna. The antenna comprises a plurality of transducers. In the example of FIG. 7, four horns of Tonpilz-type transducers are aligned in a same housing 8. FIG. 7 shows an absorbing sheath arranged on one side of the sonar. Parts of absorbing sheath may be arranged on the other sides of the housing, which extend longitudinally according to the axis 7 of the horns 4 of the transducers. The absorbing sheath is placed on one wall of the housing, the thickness of which is greater than λ, in one direction of emission of the secondary lobes. As indicated under the sonar on a magnified sectional view, the absorbing sheath 17 advantageously cooperates with a reflecting medium 18, and a diffraction grating 18.

The absorption means may comprise separated elements on outer sides of the housing, or a continuous sheath on the periphery of the housing in a plane perpendicular to the acoustic axis.

The invention thus permits to remove the secondary lobes of a sonar antenna formed of a set of transducers having substantially the same acoustic axis. The invention permits to substantially improve the directivity of such a sonar antenna, as well as the rear rejection thereof.

The invention also applies to the piezoelectric transducers of the so-called "sawn" technology or of the bounded ceramic type, used in the medical ultrasound probe or quarter-wave plate ("Diagnostic Ultrasound Imaging" ed. Elsevier, Thomas L. Szabo).

The invention claimed is:

1. An acoustic wave transducer having a bandwidth, comprising:

at least one electroacoustic motor;

a horn having an inner wall and an outer wall;

a counterweight; and a hollow housing having an inner wall and an outer wall and at least one acoustic opening, wherein said at least one motor is connected to the horn and to the counterweight, according to an axis, said motor being capable of exciting the horn at about at least one acoustic resonance frequency f, said housing being connected to the counterweight and surrounding the at least one motor and the horn, the outer wall of the horn facing an acoustic opening of the housing, and a space between the inner wall of the housing and the inner wall of the horn forming a cavity that contains a fluid, said transducer comprises an acoustic attenuator integral with the outer wall of the housing in order to attenuate at least one of the emission or reception acoustic waves at the frequency f in at least one direction transverse to the axis, and wherein said acoustic attenuator comprises an absorbing sheath fixed to the outer wall of the housing and capable of absorbing acoustic waves at the frequency f in at least one direction transverse to the axis, said acoustic attenuator further comprising a diffraction grating formed at the surface of the absorbing sheath, said diffraction grating being capable of diffracting acoustic waves in the transducer bandwidth.

2. The transducer according to claim 1, wherein the housing has a wall that extends longitudinally according to the axis and of thickness E, said thickness E being greater than the acoustic wavelength λ corresponding to the frequency f in the housing so as to absorb a part of the acoustic waves at the frequency f in at least one direction transverse to the axis.

3. The transducer according to claim 2, wherein said acoustic attenuator further comprises a reflecting sheath around the diffraction grating and suspension means capable of damping the acoustic wave coupling between the reflecting sheath and the absorbing sheath.

4. The transducer according to claim 3, wherein the reflecting sheath is made of aluminum, the absorbing sheath is made of polymer resin or syntactic foam, and the suspension means are made of viscoelastic polymer.

5. The transducer according to claim 3, wherein the reflecting sheath has a rounded outer shape so as to attenuate a part of at least one of the acoustic waves emitted or received in directions transverse to the axis.

6. The transducer according to claim 1, wherein the transducer is a Tonpilz transducer, comprising an elongated piezoelectric motor, said motor comprising a stack of piezoelectric components and electrodes, the stack being connected, according to an axis of symmetry, to the horn by one end and to the counterweight by the other end.

7. The transducer according to claim 1, wherein the transducer is a Janus-Helmholtz transducer, comprising two elongated piezoelectric motors, axes of which are aligned with each other, each motor comprising a stack of piezoelectric components and electrodes, the stack being connected, according to an axis of symmetry, to a horn by one end and to a central counterweight common to the two motors by the other end, said transducer comprising two housings surrounding each motor-horn subassembly.

8. A sonar antenna comprising a plurality of transducers, at least one transducer of the plurality of transducers being a transducer according to claim 1, said transducers being placed in a common housing.

9. The transducer according to claim 4, wherein the reflecting sheath has a rounded outer shape so as to attenuate a part of at least one of the acoustic waves emitted or received in directions transverse to the axis.

10. The transducer according to claim 2, wherein the transducer is a Tonpilz transducer, comprising an elongated piezoelectric motor, said motor comprising a stack of piezoelectric components and electrodes, the stack being connected, according to an axis of symmetry, to the horn by one end and to the counterweight by the other end.

11. The transducer according to claim 2, wherein the transducer is a Janus-Helmholtz transducer, comprising two elongated piezoelectric motors, the axes of which are aligned with each other, each motor comprising a stack of piezoelectric components and electrodes, the stack being connected, according to an axis of symmetry, to a horn by one end and to a central counterweight common to the two motors by the other end, said transducer comprising two housings surrounding each motor-horn subassembly.

12. The transducer according to claim 1, wherein said acoustic attenuator further comprises a reflecting sheath around the diffraction grating and suspension means capable of damping an acoustic wave coupling between the reflecting sheath and the absorbing sheath.

13. The transducer according to claim 12, wherein the reflecting sheath is made of aluminum, the absorbing sheath is made of polymer resin or syntactic foam, and the suspension means are made of viscoelastic polymer.

14. The transducer according to claim 1, wherein the horn is connected to the counterweight by a prestressing rod.

15. The transducer according to claim 1, wherein the motor comprises piezoelectric ceramics connected to electrodes that are subjected to a sinusoidal voltage.

16. The transducer according to claim 1, wherein the horn is configured to ensure a dual function of enlarging the transducer bandwidth due to a flicker eigenmode thereof and of adapting acoustic impedance between a ceramic and the fluid.

17. The transducer according to claim 1, wherein the counterweight shifts a nodal plane of vibration toward a rear of the transducer, ensuring a maximum transmission of energy in a desired direction of an acoustic axis toward a front of the horn.

18. The transducer according to claim 14, wherein the prestressing rod holds the acoustic motor, the horn and the counterweight as an assembly under a prestress so as to ensure operation thereof in compression only.

* * * * *